United States Patent [19]

Brannen et al.

[11] Patent Number: 4,965,002

[45] Date of Patent: Oct. 23, 1990

[54] PHOSPHITE AMINE LUBRICANT ADDITIVES

[75] Inventors: William T. Brannen, Westlake; Gerald D. Burt, Moreland Hills; Randolph A. McDonald, Berea, all of Ohio

[73] Assignee: Elco Corporation, Cleveland, Ohio

[21] Appl. No.: 148,828

[22] Filed: Jan. 27, 1988

[51] Int. Cl.[5] ..... C10M 105/74

[52] U.S. Cl. ..... 252/32.5; 252/49.6; 252/49.9

[58] Field of Search ..... 252/325, 49.5, 49.6, 252/49.9

[56] References Cited

U.S. PATENT DOCUMENTS

| | | | |
|---|---|---|---|
| 3,480,698 | 11/1969 | Cyba | 260/945 |
| 3,484,375 | 12/1969 | Hu . | |
| 4,400,284 | 8/1983 | Jessup et al. | 252/49.6 |
| 4,427,560 | 1/1984 | Holstedt et al. | 252/42.7 |
| 4,490,265 | 12/1984 | Holstedt et al. | 252/47.5 |
| 4,529,528 | 7/1985 | Horodysky | 252/49.6 |
| 4,532,057 | 7/1985 | Horodysky et al. | 252/49.8 |
| 4,533,480 | 8/1985 | Holstedt et al. | 252/46.4 |
| 4,555,353 | 11/1985 | Horodysky et al. | 252/49.6 |
| 4,557,843 | 12/1985 | Holstedt et al. | 252/46.4 |
| 4,557,844 | 12/1985 | Horodysky | 252/49.9 |
| 4,557,845 | 12/1985 | Horodysky | 252/49.9 |
| 4,587,026 | 5/1986 | Horodysky | 252/47.5 |

OTHER PUBLICATIONS

Chemical Abstracts, 103:198409b, Aqueous Systems Containing Organoborate Compounds., Eur. Pat. Appl. EP 152,677.

*Primary Examiner*—Olik Chaudhuri
*Assistant Examiner*—James M. Hunter, Jr.
*Attorney, Agent, or Firm*—Panitch Schwarze Jacobs & Nadel

[57] ABSTRACT

Lubricant additives are produced by reacting an alkoxylated amine, preferably a dialkoxy long chain alkyl amine, such as a propoxylated amine, with a disubstituted organic phosphite, preferably a dialkyl ($C_8$–$C_{30}$) phosphite. The additives preferably also contain a boron moiety which is reacted with the phosphite and amine, preferably simultaneously in a one step reaction. The additives are particularly useful in metalworking oils and particularly as extreme pressure additives to replace the currently used chlorinated paraffin additives.

20 Claims, No Drawings

PHOSPHITE AMINE LUBRICANT ADDITIVES

FIELD OF THE INVENTION

The present invention relates to reaction products of alkoxylated amines and di-substituted phosphites useful as lubricant additives. More particularly, the invention is directed to lubricant additives which can replace conventional chlorinated paraffins in applications such as extreme pressure metalworking.

BACKGROUND OF THE INVENTION

Chlorinated paraffin waxes, particularly higher molecular weight solid or liquid higher chlorinated paraffins in the $C_{10}$ to $C_{30}$ range have been widely used for over fifty years in metalworking uses, particularly as lubricant additives in drawing oils, extrusion oils and soluble oils, and particularly for extreme pressure applications. The largest volume is in drawing oils where chlorinated waxes are used almost exclusively, mainly in mineral oils. In extrusion oils, the additives usually include phosphorous and sulfur compounds due to the severity of operations. In soluble oils the chlorinated waxes are usually used in combination with fats or lard oils.

In 1977, twenty percent (40,000 tons) of the free-world production of liquid chlorinated paraffins was used in oil applications. However, in recent years, concern has arisen regarding toxicity and possible carcinogenicity of chlorinated paraffins. With the banning of chlorinated waxes in Germany and Canada, and the requirement of placing warning labels on drums of these materials in this country, alternative lubricant additives are being sought.

While many in the metalworking industry' have switched to chlorinated olefins and polyesters, there is a concern among some that these chlorinated products as well may have carcinogenic properties. Hence, non-chlorinated substitutes are considered desirable. While sulfonated products have been satisfactory for light machining applications, they have not been generally satisfactory for heavier machining, such as the severe metal cuts and draws for which the chlorinated paraffins have been favored.

In the past, a number of non-chlorine containing additives have been developed to provide lubricating oil compositions with enhanced friction characteristics for use in engine and machinery lubricating oils and fuels. Such additives have included phosphorous compounds such as metal phosphonates, alkali metal salts of alkylphosphonic acids, and dihydrocarbyl hydrocarbylphosphonates; amines, such as alkoxylated amines; and certain boron-containing compounds. Examples of these prior art lubricating oil additives are discussed, for example, at column 1 of U.S. Pat. No. 4,529,528.

Published European Patent Application No. 152,677 of Lubrizol discloses borated alkoxylated amines as thickeners for water based functional fluids. Borated alkoxylated amines are also disclosed in U.S. Pats. No. 4,400,284; 4,427,560; 4,490,265; 4,533,480 and 4,557,843 of Union Oil Company as intermediates for extreme pressure, anti-wear additives in lubricating compositions.

A series of additives has also been developed by Mobil Oil Corporation which are reaction products (essentially mixtures of simple and complex esters) of organic amines and organic phosphonates or phosphites. Early examples of such compositions are disclosed in U.S. Pat. No. 3,553,131 of Hepplewhite, et al., in which $C_6$–$C_{40}$ diaryl phosphonates (phosphites) are reacted with primary, secondary, or tertiary organic amines to produce products or mixtures which are incorporated in ester lubricants which are alleged to have higher load-carrying properties, surprising stability under storage and are relatively non-corrosive to metals.

A more recent series of patents of Horodysky, et al., assigned to Mobil, has disclosed engine lubricant and fuel additives which are the reaction product of a phosphorous compound, particularly a $C_1$–$C_6$ dihydrocarbyl phosphite, with an alkoxylated amine or a vicinal diol, with or without a boron compound, such as boric oxide, a metaborate, boric acid, or an alkyl borate. See, for example, U.S. Pats. No. 4,529,528; 4,557,845; 4,557,844; 4,555,353; 4,532,057 and 4,522,629. Mobil U.S. Pat. No. 4,587,026 also discloses borated N,N-bis(2-hydroxypropyl)cocamine in the presence of dodecyl phenol sulfide to give a friction-reducing, high temperature stabilizing additive.

While the reaction products of Heppelwhite and Horodysky, et al. are disclosed as possible additives for use with engine lubricating oils or greases, and as additives to liquid fuels such as gasoline, fuel oil and diesel oil, there is no disclosure of using these compounds for the severe requirements of metalworking fluid additives. Moreover, tests by the present inventors of several of the Horodysky, et al. products have shown serious disadvantages to the use of such products as additives to metalworking fluids, particularly in extreme pressure (EP) applications.

BRIEF SUMMARY OF THE INVENTION

According to the present invention, a lubricant additive is provided which is the reaction product of an alkoxylated amine of the formula

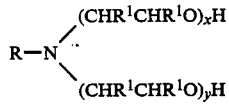

$$R-N\begin{matrix}(CHR^1CHR^1O)_xH \\ (CHR^1CHR^1O)_yH\end{matrix} \qquad (I)$$

wherein R is a $C_6$ to $C_{30}$ hydrocarbon group, each $R^1$ is individually hydrogen or a $C_1$ to $C_6$ hydrocarbon group, and x and y are integers from 0 to 10, at least one of which is not 0, preferably about 1 to 3 and more preferably both are 1, with a phosphite of the formula

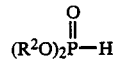

$$(R^2O)_2\overset{\overset{O}{\|}}{P}-H \qquad (II)$$

wherein $R^2$ is a $C_8$ to $C_{30}$ hydrocarbon group. The hydrocarbon groups in the above formulas are preferably alkyl groups, but may be aryl, alkenyl, cycloalkyl or cycloalkenyl, for example.

Preferably, a boron compound selected from boric oxide, a metaborate or a compound of the formula $$(R^3O)_mB(OH)_n \qquad (III)$$

wherein $R^3$ is a $C_1$ to $C_6$ alkyl group, and m and n are 0 to 3, their sum being 3, is included in the reaction with the alkoxylated amine and phosphite to form the reaction product. The phosphite is preferably a dialkyl phosphite, particularly dioleyl phosphite or dilauryl phosphite, and the boron compound where present, is preferably boric acid.

The present invention also includes lubricating oil compositions, particularly metalworking oils, containing the above reaction products as additives. These lubricating compositions may include as the major component mineral oils or synthetic oils including so-called "soluble oils" for use in forming aqueous emulsion lubricants. The invention also includes the use of the lubricant additives in metalworking operations, particularly extreme pressure operations.

DETAILED DESCRIPTION OF THE PREFERRED EMBODIMENTS

The compounds of the present invention are produced by reacting an alkoxylated amine of formula I with a disubstituted organic phosphite of formula II and preferably also a boron compound of formula III or one or more of the other boron compounds identified above. Where boron is to be included in the compounds of the invention, the reaction of the boron compound is preferably substantially simultaneous with the reaction of the alkoxylated amine and the organic phosphite, as contrasted to the two step process disclosed for similar reaction products of U.S. Pat. No. 4,529,528. That is, all three reactants are substantially mixed together prior to carrying out the reaction.

However, the reaction may also be carried out in a two step process in the manner of U.S. Pat. No. 4,529,528, either by first reacting the amine with the phosphite and then reacting the resulting product with the boron compound, or first reacting the amine with the boron compound and then reacting the phosphite with this product. Such two step reactions have been found to yield soluble though not as preferred compounds.

For the higher carbon phosphites of the present invention (e.g., $C_{12}$ and $C_{18}$), the preferred simultaneous reaction gave superior Falex activity and solubility. While applicants do not wish to be bound by any particular theory, it is believed that the two-step method (reacting amine and phosphite first) results in full esterification due to short chain phosphites and long reaction times, giving rise to a thicker end product and cross-linking when reacted with boric acid. The one step (simultaneous) reaction appears to moderate the transesterification via competition with boration and less reaction time, giving rise to a more workable end product.

The reaction proceeds readily under low to moderate heat, such as about 50° C. to 250° C., and preferably about 100° C. to 200° C. The optimum reaction time varies with the particular phosphite and amount of boron being used, but in general the reaction time should not exceed about 2-½ to 3 hours, and the long reaction times of U.S. Pat. No. 4,529,528 should be avoided. During the heating the water formed as a by-product may be removed by azeotropic distillation, and the cessation of the evolution of water generally marks the end of the reaction. For products containing higher amounts of boron, 3 hours may be required, whereas for lesser amounts or no boron, 1.5 hours may be sufficient.

The reaction is usually carried out in the presence of a solvent, preferably a liquid hydrocarbon solvent such as toluene or xylene. Upon completion of the reaction the solvent and any by-product alcohol may be removed by vacuum stripping, for example. However, reactions in which there is a low amount of boron compound generally need no solvent, because of the small amount of water evolved by the esterification reaction. If desired, a nitrogen blanket may be used to help sweep out some of the higher alcohol by-products, particularly where no solvent is used.

The compounds of the present invention are referred to as reaction products since the exact structures of the compounds are not known. While applicants do not wish to be bound by any particular theory, it is believed that the reaction products are mixtures of a number of different simple and complex esters, including possibly cross-linked species and/or prepolymers. Thus, for example, one or both of the organic oxide radicals of the phosphite compound may react with one or both of the alkoxy (hydroxy alkyl) groups on the same or different alkoxylated amines, yielding organic alcohols as by-products. Similarly, the organic oxides of the boron compounds may react with one or both of the alkoxy groups of the alkoxylated amines to yield water and/or organic alcohol by-products.

The mix and nature of the reaction products will depend in part upon the proportion of the reactants contained in the reaction mixture. Molar ratios of alkoxylated amine to organic phosphites in the range of about 0.5:1 to 4:1 are believed to be satisfactory for the present invention, and ratios of about 1:1 to 2:1 are preferred. Thus, lowering the amount of phosphite compound in the reaction tends to produce poorer results in the Falex test described below.

Where a boron compound is also present in the reaction mixture, the molar ratio of alkoxylated amine to boron compound is preferably in the range of about 30:1 to about 1:1. The ratio of organic phosphite to boron compound is suitably in the range of about 0.5:1 to 20:1, and preferably about 1:1 to 15:1. The use of low or zero amounts of boron compound generally obviates the need for a solvent for carrying out the reaction, but the presence of higher amounts of boron compound in the above range provides generally superior results in various metalworking tests and operations.

Alkoxylated amines which are useful in the present invention include, for example, 2-hydroxyethylhexylamine, 2-hydroxyethyloctylamine, 2-hydroxyethyldodecylamine, 2-hydroxyethyltetradecylamine, 2-hydroxyethylpentadecylamine, 2-hydroxyethyleicosylamine, 2-hydroxyethyltriacontylamine, 2-hydroxyethyloleylamine, 2-hydroxyethyltallowamine, 2-hydroxyethylsoyamine, bis(2-hydroxyethyl)hexylamine, bis(2-hydroxyethyl)octylamine, bis(2-hydroxyethyl)dodecylamine, bis(2-hydroxyethyl)tetradecylamine, bis(2-hydroxyethyl)pentadecylamine, bis(2-hydroxyethyl)eicosylamine, bis(2-hydroxyethyl)triacontylamine, bis(2-hydroxyethyl)oleylamine, bis(2-hydroxyethyl)tallowamine, bis(2-hydroxyethyl)soyamine, 2-hydroxylpropylhexylamine, 2-hydroxypropyloctylamine, 2-hydroxypropyidodecylamine, 2-hydroxypropyltetradecylamine, 2-hydroxypropylpentadecylamine, 2-hydroxypropyleicosylamine, 2-hydroxypropyltriacontylamine, 2-hydroxypropyloleylamine, 2-hydroxypropyltallowamine, 2-hydroxypropylsoyamine, bis(2-hydroxypropyl)hexylamine, bis(2-hydroxypropyl)octylamine, bis(2-hydroxypropyl)dodecylamine, bis(2-hydroxypropyl)tetradecylamine, bis(2-hydroxypropyl)pentadecylamine, bis(2-hydroxypropyl)eicosylamine, bis(2-hydroxypropyl)triacontylamine, bis(2-hydroxypropyl)oleylamine, bis(2-hydroxypropyl)tallowamine, bis(2-hydroxypropyl)soyamine and mixtures thereof. Also included are the comparable members wherein in the above formula at least one of x and y is at least 2, as for example, 2-hydroxyethoxyethylhexylamine.

Preferred alkoxylated amines for use in the present invention are di-lower hydroxyalkyl alkyl amines in which the alkyl (R) group is preferably $C_{10}$–$C_{20}$, and x and y are each 1. Preferred hydroxyalkyl groups are those in which $R^1$ is hydrogen or methyl or mixtures thereof. Examples include 2-hydroxyethyl and 2-hydroxypropyl. Alkoxylated amines of this series are commercially available, for example, from Armak Chemical Company under the trademarks ETHOMEEN and PROPOMEEN.

Preferred disubstituted organophosphites for use in the present invention are the dialkyl ($C_8$–$C_{20}$) phosphites (also referred to as dialkyl hydrogen phosphites). The alkyl groups of the dialkyl phosphites may be different or the same, but are preferably the same and are preferably selected from the group consisting of oleyl ($C_{18}$), lauryl ($C_{12}$) and 2-ethylhexyl ($C_8$), although the $C_8$ dialkyl phosphites have shown some solubility and storage problems.

The lower dialkyl phosphites ($C_1$–$C_6$) which are disclosed for use in the reaction products of U.S. Pat. No. 4,529,528 have been found to produce lubricant additives with serious disadvantages compared to the products of the present invention, including lower oil solubility, lower pH and higher corrosivity, lower stability in storage under adverse conditions (heat and in the presence of water), more difficultly controlled reaction with less tolerance of variations in reaction conditions, and lower flash points. While the present inventors do not wish to be bound by any particular theory, it is believed that the higher alkyl phosphites preferred in the present invention are less reactive and less likely to break down in secondary reactions, so that the reaction products of the invention are more stable under adverse conditions and more tolerant of variations in reaction conditions.

The boron compounds useful in the present invention, in addition to boric oxide and the metaborates, include boric acid, mono-, di- and trimethyl borates, mono-, di- and tripropyl borates, mono-, di- and tributyl borates, mono-, di- and triamyl borates, mono-, di- and trihexyl borates, and silica borates. Boric acid is particularly preferred, primarily due to considerations of cost and availability.

Compounds of the present invention in the acid pH range (below 7) are generally more effective in metalworking applications, which may suitably be achieved by raising the content of boron compound, as appropriate. On the other hand, the products should not be too highly acidic since this will result in corrosion of the metal being working upon. In general, the compounds of the present invention are good rust inhibitors and do not require adjustment of acidity.

However, if a compound of the present invention has a pH of below about 5.5, it is desirable to adjust or pacify the pH to a range of about 5.5–7, and preferably 6 to 6.5, with an oil soluble amine. Suitable amines for adjustment of the pH include mixtures of long chain primary amines, which are commercially available from Rohm & Haas under the trademark PRIMENE 81R, or dimethyl decyl amine, which is commercially available from Ethyl Corporation under the trademark ADMA $C_{10}$. Other pacifiers include commercially available rust inhibitors which are well known to the art.

The compounds of the present invention are particularly useful as additives in various metalworking fluids to increase the lubricating capacity of the lubricating fluid and reduce friction between metal parts. However, it will be understood by those skilled in the art that the compounds of the present invention will also have use in other lubricating environments, such as additives t engine and machinery lubricating oils.

The compounds appear to be useful for the full range of metalworking fluids from mineral oils to synthetic oils to the so-called soluble oils, the latter being emulsifiable in water for more preferred aqueous metalworking environments which provide greater cooling capacity to the metalworking operation. Thus, the additives of the present invention are readily soluble in and compatible with any of these metalworking fluids. Further, the compounds of the present invention may be used in conjunction with other metalworking fluid additives or formulation components, including sulfurized esters and active and passive sources of sulfur. Other additives, including corrosion inhibitors, surface active agents, thickeners for forming greases, and additives for specialized formulation uses, may also be included.

In general, the compounds of the present invention, particularly those formed from $C_{10}$ and higher dialkyl phosphites, are soluble in paraffinic or naphthenic base stocks up to at least 6 weight percent, which is the practical limit for use. When used in mineral oils or other synthetic lubricating oils, the compounds of the present invention are generally added in concentrations of about 0.1 to 10 weight percent, and typically about 1 to 6 weight percent. When used as additives to soluble oils which will be emulsified in aqueous metalworking formulations, the compounds of the present invention are added in concentrations of about 0.5 to 10 weight percent, and preferably 0.7 to 5 weight percent.

The compounds of the present invention, when added to metalworking fluids, provide a high degree of lubricity in any of a wide variety of metalworking or machining operations, including broaching, threading, tapping, reaming, gear cutting, deep drilling, milling, boring and various automatic screw machine operations. However, the additives of the present invention are particularly advantageous in extreme pressure (EP) operations. When used to replace chlorinated paraffins or combinations of chlorinated paraffin with lard oil, the compounds of the present invention have been found to perform equally to or better than these conventional additives in a variety of lubricants, including drawing oils, tapping oils, gear oils and water-based metalworking formulations.

The invention will now be illustrated in more detail by reference to the following specific, non-limiting examples:

PREPARATION EXAMPLE I

Preparation Example I

| Material | Grams | Moles | MW |
|---|---|---|---|
| Propomeen T/12 bis(2-hydroxypropyl) tallowamine | 365.0 | 0.955 | 382 |
| Dilauryl Phosphite | 400.0 | 0.955 | 418.6 |
| $H_3BO_3$ | 59.0 | 0.955 | 61.8 |
| Xylene (solvent) | 240 | — | — |

All materials were charged into a 2000 ml. three-necked flask fitted with a Dean-Stark trap. The reactants were heated to 150° C. and $H_2O$ was removed by azeotropic distillation at 150°-165° C. for 3 hours. Final volume of $H_2O$ removed was 42 mls. The product was stripped on a roto-vac for 3 hours at 140°-150° C. under 36 mm Hg vacuum removing all solvent. A gold colored, viscous liquid (720.3 g) was obtained. To the product was added 110.0 grams of ADMA $C_{10}$ (dimethyl decylamine) to bring the pH of the product to 5.9-6.2. Average elemental analysis after addition of ADMA $C_{10}$ was 2.3%N, 1.8%B and 3.45%P.

PREPARATION EXAMPLE II

| Preparation Example II | | | |
|---|---|---|---|
| Material | Grams | Moles | MW |
| Propomeen T/12 bis(2-hydroxypropyl) tallowamine | 136.8 | 0.358 | 382 |
| Di-oleyl Phosphite | 208.5 | 0.358 | 582 |
| $H_3BO_3$ | 22.1 | 0.358 | 61.8 |
| Xylene (solvent) | 30 | — | — |

All materials were charged into a 1000 ml. three-necked flask fitted with a Dean-Stark trap. The reactants were heated to 150° C. and $H_2O$ was azeotroped off at 150°-165° C. for 3 hours. Final volume of $H_2O$ removed was 12 mls. The product was stripped on a roto-vac for 3 hours at 140°-150° C. under 36 mm Hg vacuum to remove all solvent. A dark brownish-red colored liquid (352.0 grams) was obtained. The liquid became a semi-solid upon cooling. To the product was added 51.0 grams Primene 81R to adjust the pH to 5.9-6.2.

PREPARATION EXAMPLE III

| Preparation Example III | | | |
|---|---|---|---|
| Material | Grams | Moles | MW |
| Propomeen T/12 bis(2-hydroxypropyl) tallowamine | 142.1 | 0.372 | 382 |
| Di-oleyl Phosphite | 108.3 | 0.180 | 582 |
| $H_3BO_3$ | 0.80 | 0.013 | 61.8 |

All materials were charged into a 500 ml. three-necked flask. The reactants were heated to 150° C. and agitated for 3 hours to a pH of 5.9-6.2. A dark brownish-red liquid weighing 250.2 grams was obtained. This liquid became a muddy semi-solid liquid upon cooling to room temperature. Average elemental analysis was 2.1%N, 0.9%B, and 2.2%P.

PREPARATION EXAMPLE IV A

| Preparation Example IV A | | | |
|---|---|---|---|
| Material | Grams | Moles | MW |
| Propomeen T/12 bis(2-hydroxypropyl) tallowamine | 169.2 | 0.443 | 382 |
| Di(2-ethylhexyl) Phosphite | 135.6 | 0.443 | 306 |
| $H_3BO_3$ | 27.4 | 0.443 | 61.8 |
| Xylene (solvent) | 130 | — | — |

All materials were charged into a 1000 ml. three-necked flask fitted with a Dean-Stark trap. The reactants were heated to 150° C. and $H_2O$ was azeotroped off at 150°-165° C. for 3 hours. Final volume of water removed was 19 mls. The product was stripped on a roto-vac for 3 hours at 140°-150° C. under 36 mm Hg vacuum to remove all xylene and residual alcohol present. A gold colored, viscous liquid weighing 298.0 grams was obtained. To the product was added 42.6 g Primene 81R to adjust the pH to 5.9-6.2. Average elemental analysis after addition of Primene 81R was 2.5%N, 1.9%B, and 3.3%P.

PREPARATION EXAMPLE IV B

Example IV A above was repeated, but, in place of Primene 81R, ADMA $C_{10}$ was added to adjust the pH to 5.9-6.2. Average elemental analysis was 2.65%N, 1.9%B, and 3.7%P.

PREPARATION EXAMPLE V

| Preparation Example V | | | |
|---|---|---|---|
| Material | Grams | Moles | MW |
| Propomeen T/12 | 467.0 | 1.222 | 382 |
| Di(2-ethylhexyl) Phosphite | 187.0 | 0.611 | 306 |
| $H_3BO_3$ | 2.52 | 0.041 | 61.8 |

All materials were charged into a 1000 ml. three-necked flask fitted with a Dean-Stark trap. Using a nitrogen blanket, the reactants were heated to 150° C., and 2-ethylhexyl alcohol and residual $H_2O$ were distilled off at 150°-170° C. for 3 hours. Final volume of alcohol removed was 44 mls. A gold colored, viscous liquid weighing 620.3 grams was obtained. The product was soluble in Exxon 150N oil.

PREPARATION EXAMPLE VI

| Preparation Example VI | | | |
|---|---|---|---|
| Material | Grams | Moles | MW |
| Propomeen T/12 | 215.81 | 0.565 | 382 |
| Di-2(ethylhexyl) Phosphite | 85.87 | 0.282 | 304 |

All materials were charged into a 500 ml. three-necked flask fitted with a Dean-Stark trap. Using a nitrogen blanket, the reactants were heated to 150° C., and 2-ethylhexyl alcohol was distilled from the system at 150°-170° C. for 3 hours. Final volume of alcohol removed was 33 mls. A gold colored, viscous liquid weighing 274.5 grams was obtained. The product was soluble in Exxon 150N oil.

COMPARATIVE EXAMPLE A

Example 3 of U.S. Pat. No. 4,529,528 was repeated as follows:

| Material | Grams | Moles | MW |
|---|---|---|---|
| Ethomeen T/12 bis(2-hydroxyethyl) tallowamine | 370 | 1.06 | 350 |
| Dimethyl Phosphite | 55 | 0.5 | 110 |
| $H_3BO_3$ | 3.18 | 0.051 | 61.8 |
| Toluene (solvent) | 318 | — | — |

The Ethomeen T/12 and dimethyl phosphite were charged into a 1 liter three necked flask fitted with a Dean-Stark trap and nitrogen blanketing. The mixture was heated to 120° C. for 2 hours, 135° C. for 2 hours and 150° C. for 2.5 hours. 17 ml of MeOH were collected in the trap. To the cooled product was added the $H_3BO_3$ and toluene. These reactants were heated to the hottest temperature attainable with toluene. Final ml $H_2O$ was about 2 ml with a maximum temperature of 123° C. Product was stripped at 150° C. for 3 hours. The product was an extremely thick indian red liquid which was hazy. It was dissolved at 5% in Exxon 150N using considerable heat and tested on the Falex Lubricant Tester. Falex gave 2000# fail with bad jaw wear. The pH of the oil solution was 7.10.

COMPARATIVE EXAMPLE B

Example 4 of U.S. Pat. No. 4,529,528 was repeated as follows, using a cocoamine instead of the oleylamine:

| Material | Grams | Moles | MW |
|---|---|---|---|
| Propomeen C/12 bis(2-hydroxypropyl) cocoamine | 370 | 0.974 | 380 |
| Dimethyl Phosphite | 55 | 0.500 | 110 |
| $H_3BO_3$ | 64.7 | 1.05 | 61.8 |
| Toluene (solvent) | 200 (ml) | — | — |

The Propomeen C/12 and the dimethyl phosphite were charged into a 1 liter three necked flask fitted with a Dean-Stark trap and nitrogen blanketing. The mixture was heated to 120° C. for 2 hours, 135° C. for 2 hours and 150° C. for 2 hours. 22 ml of MeOH were collected in the trap. To the cooled product was added the $H_3BO_3$ and toluene. This mixture was heated to the hottest temperature attainable using a toluene solvent for the azeotrope. 34 ml of $H_2O$ came off and final temperature was 123.5° C. after a 6 hour reaction time. The product was vacuum stripped for 3 hours at 150° C. The final product was a somewhat hazy, gold material on the borderline of being a solid (taffy-like). It was insoluble in oil and pH solvent (butanol/kerosene/$H_2O$ mix), and therefore no Falex or pH data were available.

TEST RESULTS

The products from the above Preparation Examples were tested in several standard tests which have been developed for metalworking fluids as described below. In these tests, the compounds of the invention were compared to one or more of the following standard or competitive lubricants on the market: (1) CLEARTEX D, a product of Texaco having a high concentration (15–20%) of chlorinated wax; (2) LUBRIZOL LZ-5347, a PEP metalworking additive containing carbonated alkyl benzene sulfonates; and (3) a standard additive formulation comprising 25% P145 chlorinated wax (40% chlorine) from Dover Chemical Corp. and 75% lard oil (referred to in the Tables below as "wax +LO").

Except for the CLEARTEX D, which is a pre-formulated oil already containing the chlorinated wax additive, the additives tested were added to various oils identified below at the weight percentages indicated in the following Tables setting forth the results of each test.

Strip Draw Test: This test, also known as a bead draw test, uses a modified tensile tester having flat polished dies to determine the coefficient of friction of the lubricant itself. The dies are then changed to a configuration having a bead on one die and a corresponding indentation on the other die to test the effect of the lubricant when a strip of metal is drawn or deformed around the draw bead. The relative initial static, initial dynamic and final dynamic frictions (meter readings only) are given in Table I for a strip draw test using a 6-½" diameter ram with 500 p.s.i. jaw pressure and a total of 1.75" strip travel. Generally, lower readings are better, but it is also desirable to have the least amount of change in the readings from initial static to final dynamic friction. In each case, the additive was dissolved in a standard blend of Witco GOLDEN BEAR and #105 pale oil at 300SUS. The stick slip numbers are a measurement of lubricity, with lower numbers being better.

Limiting Dome Height (LDH): In this test, also referred to as a cup forming test, a series of sheet metal specimens of varying width are stretched by a 100 mm hemispherical punch until fracture occurs. The height at which this fracture occurs is referred to as the dome height and is an indication of the maximum stretch-forming capability of the sheet metal material. This test is commonly used in Ford Motor Company stamping plants and has been expanded to evaluate the ability of lubricants to improve drawing results on all types of metals. This test is described in further detail in the August 1987 issue of *Metal Stamping*, pages 3–13. The results of tests using mineral seal oil in which the additives were dissolved are given in Table II, stated as the percentage improvement of the additive over mineral seal oil alone. An improvement of 0.5% or more is considered significant.

Rust Tests: Table III sets forth the results of three different tests to determine the corrosion effect of various additives in (Exxon 150N mineral oil). In the two ASTM tests, a mixture of 300 ml of the mineral oil with 0.75 weight percent additive is mixed with 30 ml of distilled water (ASTM D-665A) or synthetic sea water (ASTM D-665B) at a temperature of 60° C. with two cylindrical steel specimens completely immersed therein for a period of 24 hours. The specimens are observed for signs of rusting. Both test specimens in each test must be rust free in order to receive a passing report. In the chip test (Texaco Method No. ST-114), clean, dry, cast-iron chips are soaked in emulsions of a soluble oil, prepared by blending 15% of additive in Exxon 150N and emulsifying this blend at 5% in 100 ppm hardness water. The chips are then drained and spread evenly on the bottom of a Petri dish and are then allowed to dry and stand overnight in a controlled atmosphere. Out of 15 ml of standard test chips, 10 or fewer chips may have rust to receive a passing rating.

Wear Tests: In Table IV, the results of various wear tests are set forth using 1%, 2% or 3% (as indicated) of each additive dissolved in Exxon ISO-46 mineral oil. The 4-Ball EP test (ASTM D-2783) measures the extreme pressure characteristics of a lubricant by a Load Wear Index (LWI) and a weld point. A test ball is rotated under load at a tetrahedral position on top of three stationary balls immersed in lubricant. Measurements of scars on the three stationary balls are used to calculate LWI's, and the weld is the load at which the four balls weld together in 10 seconds. The higher the values the better. The 4-Ball Wear test (ASTM D-2266) measures the wear (displacement of metal by friction) when a test ball is rotated in a tetrahedral position on top of three stationary balls or discs. Wear is indicated by scar diameters on the three stationary balls or discs. The Timken test (ASTM D-2782) simulates the extreme pressure between a bearing and gear by revolving a test cup against a test block provided with lubricant. Load is increased at 5 pound intervals until scoring of the test block occurs. The results are given as the highest load pressure at which no scoring occurred (P or pass) and the lowest pressure at which scoring occurred (F or fail).

Falex EP Tests: In Table V are given the results of tests on the Falex (FAVILLE-LeVALLY) lubricant tester, which is described for example in United States Steel Lubrication Engineers Manual, pages 136–137. In these tests, a brass pin revolves at 290 rpm between two steel blocks immersed in the oil while the pressure exerted between the blocks on the pin is increased until the brass pin fails, either by sudden shearing or wear occurring at a rate faster than the load can be increased. The failure load in p.s.i. is given with 4500 p.s.i. being the maximum test load. In the tests reported in Table V, each additive was dissolved at a concentration of 5% in Exxon 150N mineral oil or in the case of the emulsion was prepared as for the Texaco chip test above (5% modified oil in water or 0.75% additive in the total emulsion). In some cases, multiple tests of the same material or different batches were made, and both results are given in Table V.

Emulsion Stability Tests: The emulsion stability results given in Table V show the ability of an oil (Exxon 150N) containing 15 weight percent additive to stay in five different 5% oil in water emulsions (77° F. 100 ppm hardness water, 180° F. 100 ppm hardness water, 45° F. 100 ppm hardness water, 45° F. 300 ppm hardness water, and 45° F. 600 ppm hardness water) for one and 24 hour periods.

FZG Wear Test: Additives from Examples II and V were dissolved at 1% concentration in BP ISO 68 oil in the multi-stage FZG wear test. This is a German test, which closely simulates field operation of gears which are subjected to loads. The test measures wear characteristics like the Timken test and is described in more detail in C. A. Bailey, "The Four-Square-Gear Oil Tester," *Iron and Steel Engineer* (June 1965). As indicated in Table V, these two additives gave 11 stage and 12 stage passes, which are very high and surprising, since generally only blends of sulfur and phosphorous components can achieve a 12 stage pass.

Falex #8 Tapping Torque Test: This test is intended to measure the cutting efficiency of cutting fluids by recording torque forces on a tapping machine made by the Faville-LeVally Corporation. This test is described in more detail in *Lubrication Engineering,* 36:513–529 (1980). All additives were dissolved in 100/100 pale oil.

Based on the test results shown in the attached Tables, the compounds of the present invention, when added to mineral oil lubricants, show excellent metal-working properties in a broad spectrum of tests, as well as good corrosion resistance. The test results compare very favorably to reference oils such as CLEARTEX D and chlorinated wax plus lard oil additive. The tests indicate an optimum concentration of about 3 weight percent when added to the lubricant oils.

The present invention may be embodied in other specific forms without departing from the spirit or the central attributes thereof and, accordingly, reference should be made to the appended claims, rather than to the foregoing specification as indicating the scope of the invention.

TABLE I

STRIP DRAW TEST

| Additive | Wt. % | Initial Static Friction | Initial Dynamic Friction | Final Dynamic Friction | Stick Slip* |
|---|---|---|---|---|---|
| LZ-5347 | 7.5 | 1200 | 2050 | 2400 | 3 |
| | | 1200 | 2100 | 2600 | 3 |
| Wax + LO | 20 | 1200 | 2050 | 2100 | 2 |
| | | 1200 | 2050 | 2050 | 2 |
| Ex. I | 3 | 1620 | 2300 | >3000 | 3 |
| | 6 | 1200 | 1650 | 1900 | 2 |
| Ex. II | 3 | 1200 | 2100 | 2150 | 3 |
| | 6 | 1200 | 1950 | 2150 | 2 |
| Ex. III | 3 | 1300 | 2020 | 2050 | 3 |
| | 6 | 1200 | 1800 | 2150 | 0 |
| Ex. IVA | 3 | 1300 | 2000 | 2050 | 3 |
| | 6 | 1300 | 2300 | 2100 | 3 |
| Ex. IVB | 3 | 1200 | 1850 | 2150 | 3 |
| | 6 | 1300 | 2050 | 2150 | 2 |
| | | 1200 | 2100 | 2200 | 3 |
| Ex. V | 3 | 2150 | 2150 | >3000 | — |
| | 6 | 1300 | 2200 | 2150 | 3 |
| Ex. VI | 3 | 1150 | 2100 | 2200 | 3 |
| | 6 | 1200 | 2070 | 2100 | 3 |

*0 = None; 1 = Low; 2 = Medium; 3 = High

TABLE II

LIMITING DOME HEIGHT (LDH) TESTER

| Additive | Wt. % | % Improvement Over Mineral Seal Oil |
|---|---|---|
| LZ-5347 | 7.5 | 0.16 |
| Wax + LO | 20 | 1.5 |
| Ex. I | 3 | 3.0 |
| | 6 | 5.2 |
| Ex. II | 3 | 1.8 |
| | 6 | 2.5 |
| Ex. III | 3 | 1.9 |
| | 6 | 3.7 |
| Ex. IVA | 3 | 3.0 |
| | 6 | 2.5 |
| Ex. IVB | 3 | 2.8 |
| | 6 | 2.7 |
| Ex. V | 3 | 0.16 |
| | 6 | 1.3 |
| Ex. VI | 3 | 1.5 |
| | 6 | 2.2 |

TABLE III

RUST TESTS

| Additive | ASTM D-665A | ASTM D-665B | Chip Test |
|---|---|---|---|
| LZ-5347 | Pass | Fail | Pass |
| Wax + LO | Fail | Fail | Fail |
| Ex. I | Pass | Marginal Fail | Pass |
| Ex. II | Pass | Fail | Pass |
| Ex. III | Pass | Pass | Pass |
| Ex. IVA | Pass | Fail | Pass |
| Ex. IVB | Pass | Pass | Pass |
| Ex. V | Pass | Pass | Pass |
| Ex. VI | Pass | Pass | Pass |

TABLE IV

WEAR TESTS

| Additive | 4-Ball EP 1 % LWI | 4-Ball EP 1 % Weld | 4-Ball EP 2 % LWI | 4-Ball EP 2 % Weld | 4-Ball Wear mm scar dia 1 % | 4-Ball Wear mm scar dia 2 % | Timken 1 % | Timken 2 % |
|---|---|---|---|---|---|---|---|---|
| LZ-5347 | 24.7 | 200 | 25.9 | 200 | 0.27 | 0.27 | | |
| Wax + LO | 27.1 | 160 | 37.1 | 250 | 0.33 | 0.30 | | |
| Ex. I | 40.0 | 200 | 47.8 | 250 | 0.30 | 0.29 | P25 F30 | P30 F35 |
| Ex. IVA | 36.1 | 160 | 40.0 | 200 | 0.36 | 0.38 | P25 | P35 |

TABLE IV-continued

| WEAR TESTS | | | | | | | | |
|---|---|---|---|---|---|---|---|---|
| Ex. IVB | 32.2 | 160 | 42.7 | 200 | 0.36 | 0.34 | F30 P25 F30 | F40 P30 F35 |
| Additive | 3 % LWI | 3 % Weld | | | 3 % | | | |
| LZ-5347 | 27.5 | 160 | | | 0.33 | | | |
| Ex. I | 41.8 | 200 | | | 0.35 | | | |
| Ex. III | 41.4 | 200 | | | 0.35 | | | |
| Ex. IVA | 43.7 | 200 | | | 0.38 | | | |
| Ex. IVB | 41.7 | 200 | | | 0.37 | | | |

TABLE V

| FALEX EP + FZG TESTS | | | | | |
|---|---|---|---|---|---|
| Additive | Wt. % | Falex EP 5% Oil | Falex EP 5% Emulsion | Emulsion Stability | FZG EP + Wear Test |
| LZ-5347 | 7.5 | 1750 | 1000 | Failed before 1 hr. | |
| Wax + LO | 20 | 4500+ | 2250 (no emulsion) | No emulsion | |
| Ex. I | 5 | 2350 | 4000 | Pass 1 hr. | |
| | 3 | 3500 | | Fail 24 hr. | |
| Ex. II | 5 | 3750 | | | Pass 12 stages |
| | 5 | 3250 | | | (1% additive) |
| Ex. III | 5 | 4500+ | 2250 | Pass 1 hr. | |
| | 3 | 4000 | | Fail 24 hr. | |
| Ex. IVA | 5 | 2250 | 3250 | Pass 1 hr. | |
| | 5 | 2500 | | Fail 24 hr. | |
| | 3 | 3250 | | | |
| Ex. IVB | 5 | 4000 | 2500 | Pass: all 5 | |
| | 5 | 3500 | 2500 | emulsions | |
| | 3 | 3500 | | stable after 24 hours | |
| Ex. V | 5 | 4000 | 1500 | Pass: all 5 | Pass 11 stages |
| | 5 | 4500 | 1250 | emulsions stable after 24 hours | |
| Ex. VI | 5 | 3750 | 1750 | Pass: all 5 | |
| | 5 | 2750 | | emulsions stable after 24 hours | |

TABLE VI

| FALEX #8 TAPPING TORQUE TEST | | |
|---|---|---|
| Additive | Wt. % | Percent Efficiency |
| Cleartex D | — | 100.0 |
| LZ-5347 | 7.5 | 95.0 |
| Wax + LO | 20 | 95.3 |
| Ex. I | 3 | 102.0 |
| | 5 | 99.2 |
| Ex. III | 3 | 101.1 |
| | 5 | 99.1 |
| Ex. IVA | 3 | 100.6 |
| | 5 | 97.3 |
| Ex. IVB | 3 | 101.8 |
| | 5 | 98.9 |
| Formulations | | |
| LZ-4357 + | 2.5 | 99.4 |
| ELCO 213 | 2.5 | |
| Ex. I + | 2.5 | 99.2 |
| ELCO 213 | 2.5 | |
| Ex. IVA + | 2.5 | 100.1 |
| ELCO 213 | 2.5 | |
| Chloroparaffin (?) + | 1.5 | 99.4 |
| ELCO 230 | 5 | |
| Ex. I + | 1.5 | 98.3 |
| ELCO 230 | 5 | |
| Ex. IVA + | 1.5 | 98.4 |
| ELCO 230 | 5 | |

ELCO 213 and ELCO 230 are sulfurized ester additives available commercially from The Elco Corporation.

We claim:

1. A lubricant additive comprising the reaction product of (a) an alkoxylated amine of the formula

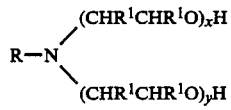

(I)

wherein R is a $C_6$ to $C_{30}$ hydrocarbon group, each $R^1$ is individually hydrogen or a $C_1$ to $C_6$ hydrocarbon group, and x and y are integers from 0 to 10, at least one of which is not 0, with (b) a phosphite of the formula

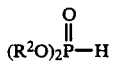

(II)

wherein $R^2$ is a $C_8$ to $C_{30}$ hydrocarbon group.

2. A product according to claim 1 wherein the reaction product is the reaction product of (I) and (II) with (c) a boron compound selected from the group consisting of boric oxide, a metaborate, and a compound of the formula $$(R^3O)_mB(OH)_n \quad \text{(III)}$$

wherein $R^3$ is a $C_1$ to $C_6$ alkyl group, and m and n are 0 to 3, their sum being 3.

3. A product according to claim 2 wherein the reaction of (a), (b) and (c) is substantially simultaneous.

4. A product according to claim 2 wherein the reaction is carried out at a temperature of about 50° to 250° C.

5. A product according to claim 2 wherein said boron compound is boric acid.

6. A product according to claim 2 wherein the molar ratio of amine compound to boron compound in the reaction is about 30:1 to 1:1.

7. A product according to claim 2 wherein the molar ratio of phosphite compound to boron compound in the reaction is about 0.5:1 to 20:1.

8. A product according to claim 1 wherein the molar ratio of amine compound to phosphite compound is 0.5:1 to 4:1.

9. A product according to claim 1 wherein said phosphite is a dialkyl phosphite.

10. A product according to claim 9 wherein said phosphite is selected from the group consisting of diol-eyl phosphite, dilauryl phosphite, and di(2-ethylhexyl) phosphite.

11. A product according to claim 1 wherein said alkoxylated amine is selected from the group in which R is $C_{10}$ to $C_{20}$ alkyl, $R^1$ is hydrogen, methyl or a mixture thereof, and x and y are each 1.

12. A product according to claim 11 wherein said alkoxylated amine is bis(2-hydroxypropyl)tallowamine.

13. A lubricant composition comprising a major proportion of a lubricating oil and a friction reducing amount of a lubricant additive comprising the reaction product of (a) an alkoxylated amine of the formula

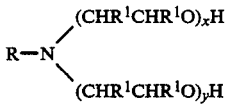

(I)

wherein R is a $C_6$ to $C_{30}$ hydrocarbon group, each $R^1$ is individually hydrogen or a $C_1$ to $C_6$ hydrocarbon group, and x and y are integers of from 0 to 10, at least one of which is not 0, with (b) a phosphite of the formula

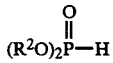

(II)

wherein $R^2$ is a $C_8$ to $C_{30}$ hydrocarbon group.

14. A lubricant composition according to claim 13 wherein said lubricating oil is a soluble oil emulsifiable in water.

15. A lubricant composition according to claim 13 wherein the pH of said product is adjusted to about 5.5 to 7 by addition of an alkyl amine.

16. A composition according to claim 13 wherein said product is present in the oil in an amount of about 0.1 to 10 weight percent.

17. A method of lubricating a metalworking operation comprising performing said operation in the presence of a lubricating oil containing a lubricant additive comprising the reaction product of (a) an alkoxylated amine of the formula

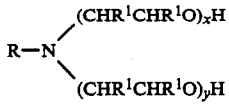

(I)

wherein R is a $C_6$ to $C_{30}$ hydrocarbon group, each $R^1$ is individually hydrogen or a $C_1$ to $C_6$ hydrocarbon group, and x and y are integers of from 0 to 10, at least one which is not 0, with (b) a phosphite of the formula

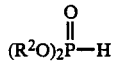

(II)

wherein $R^2$ is a $C_8$ to $C_{30}$ hydrocarbon group.

18. A method according to claim 17 wherein said operation is an extreme pressure operation.

19. A method of making a lubricant additive comprising reacting (a) an alkoxylated amine of the formula

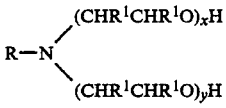

(I)

wherein R is a $C_6$ to $C_{30}$ hydrocarbon group, each $R^1$ is individually hydrogen or a $C_1$ to $C_6$ hydrocarbon group, and x and y are integers of from 0 to 10, at least one of which is not 0;

(b) a phosphite of the formula

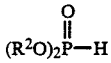

(II)

wherein $R^2$ is a $C_8$ to $C_{30}$ hydrocarbon group; and (c) a boron compound selected from the group consisting of boric oxide, a metaborate, and a compound of the formula $$(R^3O)_mB(OH)_n \quad \text{(III)}$$

wherein $R^3$ is a $C_1$ to $C_6$ alkyl group, and m and n are 0 to 3, their sum being 3; and wherein (a) (b) and (c) are reacted substantially simultaneously.

20. A method according to claim 19 wherein said reaction is in the absence of a solvent.

* * * * *